US005749199A

United States Patent [19]

Allen

[11] Patent Number: 5,749,199

[45] Date of Patent: May 12, 1998

[54] FIBER BALE COMPOSITE STRUCTURAL BUILDING SYSTEM

[75] Inventor: Joseph Allen, Clarkston, Wash.

[73] Assignee: Bale Built, Inc., Lewiston, Id.

[21] Appl. No.: 715,994

[22] Filed: Sep. 19, 1996

[51] Int. Cl.[6] ..... E04C 3/36

[52] U.S. Cl. ..... 52/729.1; 52/729.2; 52/DIG. 9

[58] Field of Search ..... 52/690, 639, 729.1, 52/729.2, 729.3, 729.4, 729.5, DIG. 9

[56] References Cited

U.S. PATENT DOCUMENTS

| | | | |
|---|---|---|---|
| 225,065 | 3/1880 | Leeds | 52/600 |
| 312,375 | 2/1885 | Orr | 52/223.7 |
| 2,202,850 | 6/1940 | Guignon | 52/761 |
| 2,372,200 | 3/1945 | Hayes | 52/259 |
| 2,490,537 | 12/1949 | Myer | 52/234 |
| 3,824,754 | 7/1974 | Fatosme et al. | 52/228 |
| 4,034,529 | 7/1977 | Lampus | 52/690 X |
| 4,074,498 | 2/1978 | Keller et al. | 52/690 |
| 4,397,128 | 8/1983 | Wolde-Tinsae | 52/293 |
| 4,602,461 | 7/1986 | Cumins et al. | 52/639 X |
| 5,285,616 | 2/1994 | Tripp | 52/DIG. 9 X |
| 5,398,472 | 3/1995 | Eicheldraut | 52/443 |
| 5,412,921 | 5/1995 | Tripp | 52/DIG. 9 X |

*Primary Examiner*—Beth Aubrey
*Attorney, Agent, or Firm*—Steven R. Ormiston

[57] ABSTRACT

Straw bales are used in conjunction with a skeletal framework to form various structurally stable building components such as walls and floors. Straw bales and horizontal trussing members are combined to form a truss. The truss has of a pair of trussing members operatively connected to one or more bales. The trussing members, which are positioned opposite one another along the edges of the bale, form the chords of the truss. The bales form the web of the truss. The trussing members are one of the basic components of the skeletal framework used to construct the various composite structures embodying the invention. In the composite structures, straw bales are arranged in layers within a skeletal framework. The skeletal framework includes the trussing members and a series of rods positioned along the center line of the layered bales. The trussing members in each pair are positioned opposite one another along the edges of the bales at the interfaces between the layers of bales. Each trussing member is operatively connected to the bales to form a truss.

44 Claims, 14 Drawing Sheets

FIBER BALE COMPOSITE STRUCTURAL BUILDING SYSTEM

FIELD OF THE INVENTION

The invention relates generally to structural building systems and, more particularly, to a composite structural building system that utilizes a skeletal framework in conjunction with fiber bales to form walls, roof and floor panels and other structures.

BACKGROUND

Straw is an inexpensive and readily available renewable resource. Historically, straw has been used in building materials as a binder. Straw bales have been used in building construction as non-structural envelopment components to provide form and thermal and sound insulation. Straw bales have not been widely used in engineered construction primarily because the bales have inherent structural limitations. The basic factor hindering the use of baled straw in construction is its low modulus of elasticity (that is, a flat stress versus strain curve). Considerable deformation has to take place to mobilize the compressive strength of a straw bale. The modulus of elasticity for baled straw is approximately 50 psi. In comparison, the modulus of elasticity for Douglas Fir timber is 1,300,000 psi, which is 30,000 times greater than baled straw, and 29,000,000 psi for steel, which is 550,000 times greater than baled straw. This means that baled straw is not a viable option as a primary structural load bearing element. A bearing wall constructed solely of straw bales, for example, would deform so much that its distortion would not be compatible with the comparatively rigid ancillary components, such as dry wall, plaster, stucco, steel sheeting or plywood, required to make a functional finished wall.

Structures that incorporate straw bales as a non-structural component for insulative purposes can be broadly termed straw in-fill structures. One such system is disclosed in U.S. Pat. No. 5,398,472, entitled Fiber-Bale Composite Structural System And Method and issued to Eichelkraut on Mar. 21, 1995. The Eichelkraut system uses cast in place reinforced concrete with fiber bale insulation in-fill. In Eichelkraut, contiguously arranged bales are sandwiched between layers of concrete applied to the exposed faces of the bales. The bales are reinforced with concrete or steel columns located in open channels or gaps left within the arranged bales and cross ties that are embedded in and extend between the exterior layers of concrete. The reinforcing framework of Eichelkraut functions independently of the bales of straw. That is, the bales are not tied into the framework as a structural element.

Other older and more basic straw bale structures are known in the art. For example, U.S. Pat. No. 225,065, entitled Building Houses, Barns, Fences, etc. and issued to Leeds on Mar. 2, 1880 discloses a structure consisting of straw bales stacked within wooden corner posts and a plate or joist along the top of the stacked bales. U.S. Pat. No. 312,375, entitled Wall Of Buildings And Other Structures and issued to Orr on Feb. 17, 1885 describes a system wherein bales are stacked between two compression plates located at the bottom and top of the wall. Like the structure disclosed in Eichelkraut, these structures do not utilize the strength of the straw bales to improve the structural integrity of the building.

SUMMARY OF THE INVENTION

The present invention is directed to a composite structural system that uses fiber bales in conjunction with a skeletal framework to form various structurally stable building components. Presently, grain straw is one of the most inexpensive and readily available sources of fiber for baling. Therefore, the invention will be described with reference to straw as the baled fiber material. It is to be understood, however, that "bales", "fiber bales", or "straw bales" as those terms are used in this specification and in the claims refer broadly to straw, hay, wood fiber, shredded paper or any other material that is pressed or bundled into bales or similar such rectangular block type building units. Other three dimensional rectilinear forms of baled material could also be used.

Baled straw possesses sufficient usable shear capacity to stabilize the direct stress carrying elements of a framework that is sandwiched in a matrix of stacked bales. The stacked bales provide a desirable component of the structural system due to their insulating qualities and they are a necessary part of the system from a structural standpoint. The bales provide a spatial containment medium allowing the use of integral trussing elements and rods to perform dual functions—the load carrying capacity of the structure with minimum distortion and the attachment framework for the finished wall, roof, floor or ceiling surfacing. The bale matrix provides a deep truss geometry allowing a minimal weight to load capacity ratio and a bracing function for the compression elements that allow them to be used at a high stress level. The bales are stacked vertically to form wall systems or laid horizontally in rows to form plank systems for floors and roofs. The bales can be engineered as to size, shape, density and/or moisture content, as necessary, to achieve the desired structural characteristics.

At an elemental level, straw bales and trussing members are combined to form a truss. The truss consists of a pair of trussing members operatively connected to one or more bales. The trussing members, which are positioned opposite one another along the edges of the bale, form the chords of the truss. The bales form the web of the truss. Tooth like projections that project from the trussing members into the bale are one preferred mechanism through which the trussing members are operatively connected to the bales.

The trussing members are one of the basic components of the skeletal frameworks used to construct the various composite structures embodying the invention. In the composite structural building system of the invention, where straw bales are arranged in layers within a skeletal framework, the skeletal framework also includes a series of rods positioned along the layered bales. The trussing members are arranged in pairs. The trussing members in each pair are positioned opposite one another along the edges of the bales at the interfaces between the layers of bales. Each trussing member is operatively connected to the bales to form a truss. In one exemplary embodiment of the invention, the straw bales are stacked vertically in a staggered "running bond" configuration to form a wall. In the skeletal framework for the wall, the rods are oriented vertically and positioned along the center line of the layered bales. The trussing members in each pair of trussing members are positioned opposite one another along the edges of the bales at the horizontal interfaces between the layers of bales. The trussing members are operatively connected to the bales through a series of tooth like projections projecting from the trussing members into the bales, or through another suitable shear transfer mechanism. Preferably, the rods will be stabilized by adding cross ties, ties straps and shear plates to the skeletal framework. The cross ties are oriented horizontally and extend between the trussing members. Each cross tie is operatively coupled to one of the rods to stabilize the rod laterally, perpendicular to the plane of the wall. The tie straps extend lengthwise along the horizontal interfaces between the rows of bales. Each tie strap is operatively connected between at least two rods to stabilize the rods laterally, in the plane of the wall. The shear plates are operatively connected between the bales and the rods at the horizontal interfaces between the rows of bales. Tooth like projections projecting vertically from each shear plate penetrate the bales and thereby operatively connect the shear plates to the bales.

In a second exemplary embodiment of the invention, the bales are arranged in layers in a horizontal plane to form a wide flat plank to be used as a roof or floor type panel. The skeletal framework for this plank system is much like the skeletal framework for the wall except that the rods are oriented horizontally, the cross ties (now called struts) are oriented vertically and the tie straps and shear plates are deleted. Web ties are added between the paired trussing members to help support the increased shear loading imposed on the plank in comparison to the wall. The web ties extend diagonally between trussing members. The web ties are attached to the trussing members at the points of intersection of the struts and the trussing members. Typically, bearing brackets will be installed at the ends of the plank to facilitate attaching the plank to external supports.

In a third exemplary embodiment of the invention, the bales and framework are combined to form a two way beam system such as might be used for fences or other free standing wall systems. The skeletal framework for the two way beam system is much like the skeletal framework for the wall, except diagonal web ties are added to the system between the trussing members at the bottom of the beam. These web ties are placed in symmetry on the front and back faces of the beam. End bearing frames may be built into the beams to provide laterally stable points of attachment to support footings.

BRIEF DESCRIPTION OF THE DRAWINGS

Like reference numbers refer to like components in all Figures.

DETAILED DESCRIPTION OF THE INVENTION

Figure 1:
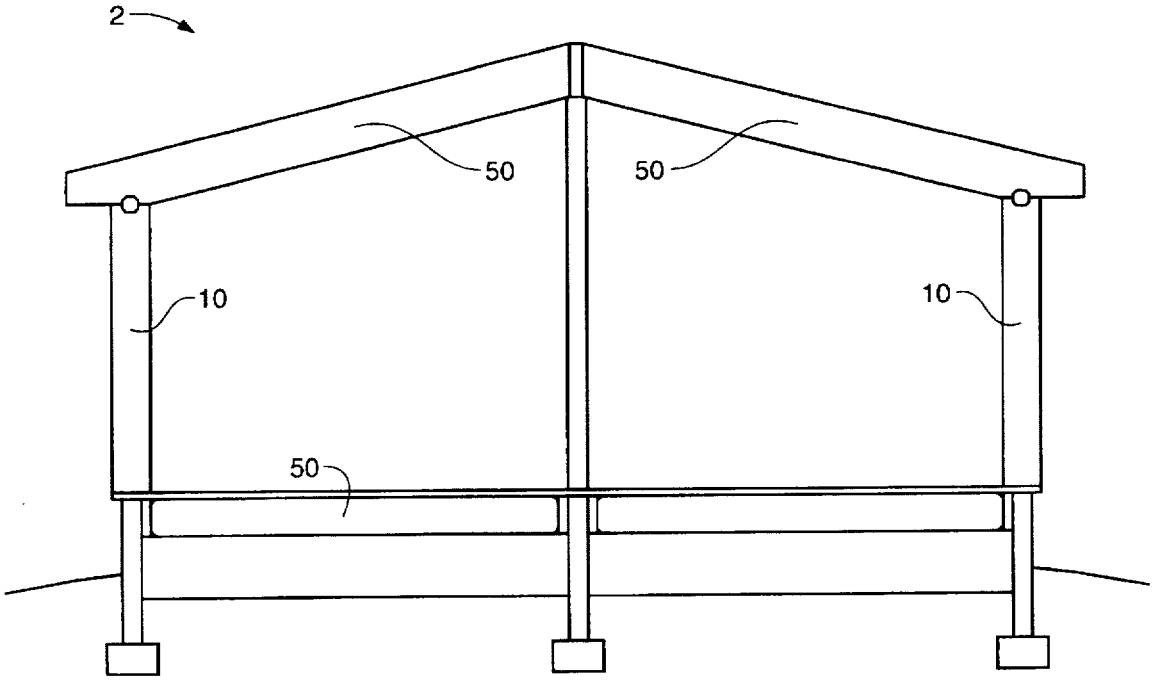
FIG. 1 is a representational elevation view of a building constructed using the wall and plank systems.

FIG. 1 illustrates a typical residential or commercial building, designated generally by reference number 2, into which the various embodiments of the invention detailed below might be incorporated. For example, the walls of building 2 might be constructed according to the wall system 10, shown in detail in FIGS. 5–7, and the floors and roof constructed according to the plank system 50, shown in detail in FIGS. 11–13. The invention, however, is not limited to the embodiments described herein. The invention provides a recipe for the fabrication of composite structures or structural modules for use as or in buildings, as free standing wall systems such as fences or sound barriers, or any other structure where the use of straw bales is desired. The structures can be fabricated in place on the building site or off site in transportable sizes for relocation to the building site.

Figure 2:
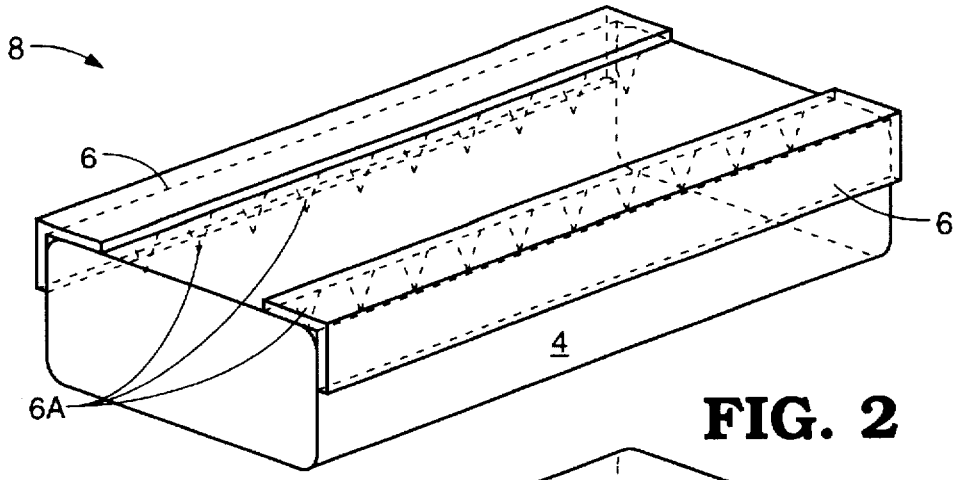
FIG. 2 is a perspective view of a composite truss that consists of a pair of trussing members operatively connected to a bale.
Figure 3:
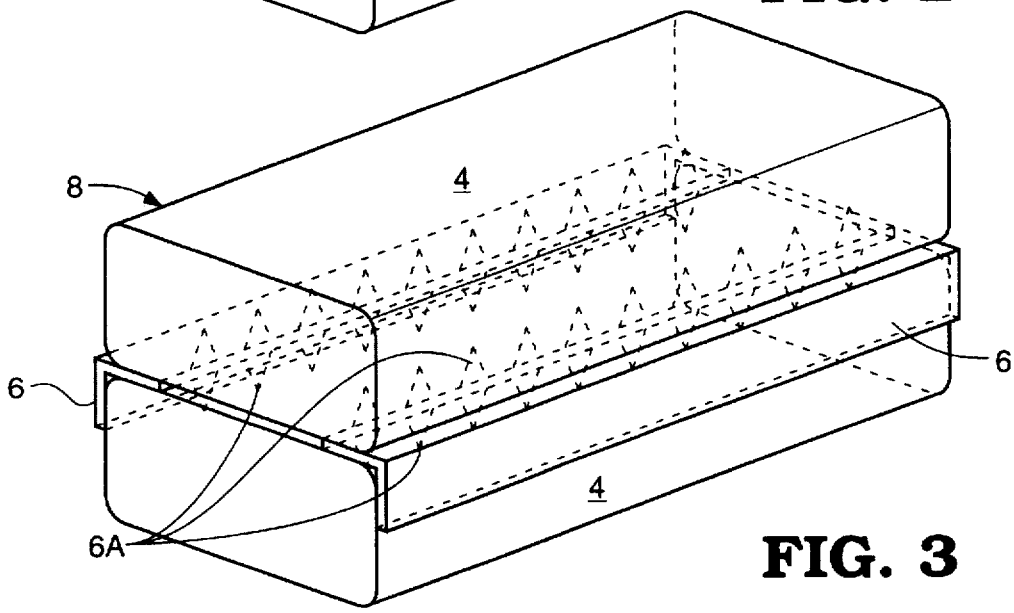
FIG. 3 is a perspective view of a composite truss that consists of a pair of trussing members operatively connected to and sandwiched between two bales.
Figure 4:
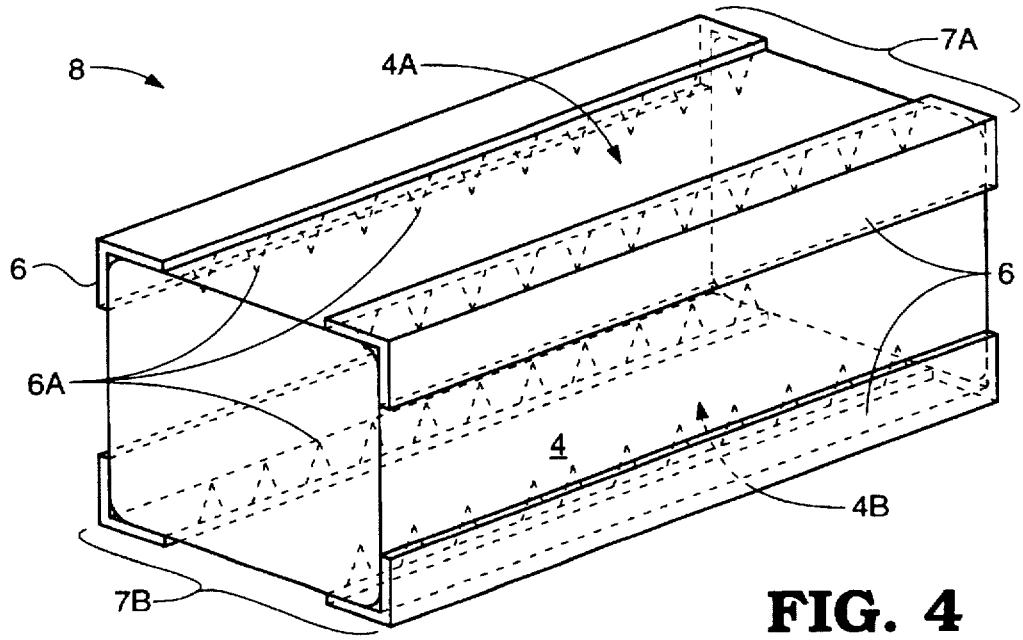
FIG. 4 is a perspective view of a composite truss that consists of two pair of trussing members operatively connected to a bale.

Referring to FIGS. 2–4, straw bales 4 and trussing members 6 are combined to form a truss 8. In one version of this composite truss, shown in FIG. 2, truss 8 consists of a pair of trussing members 6 operatively connected to one bale 4. Trussing members 6 are positioned opposite one another along the edges of bale 4 to form the chords of truss 8. Bale 4 forms the web of truss 8. The operative connection between trussing members 6 and bale 4 is made by tooth like projections 6A that penetrate into bale 4. In another version of truss 8, shown in FIG. 3, trussing members 6 are sandwiched between a pair of bales 4 stacked one over the other. Again, the operative connection between bales 4 and trussing members 6 is made by projections 6A that penetrate into both bales. In a third version of the truss, shown in FIG. 4, truss 8 includes two pairs of trussing members 7A and 7B operatively connected to bale 4 through projections 6A. The trussing members 6 in each pair of trussing members 7A and 7B are positioned opposite one another along the edges of bale 4. One pair of trussing members 7A is positioned at the top face 4A of bale 4. The other pair of trussing members 7B is positioned at the bottom face 4B of bale 4.

Figure 5:
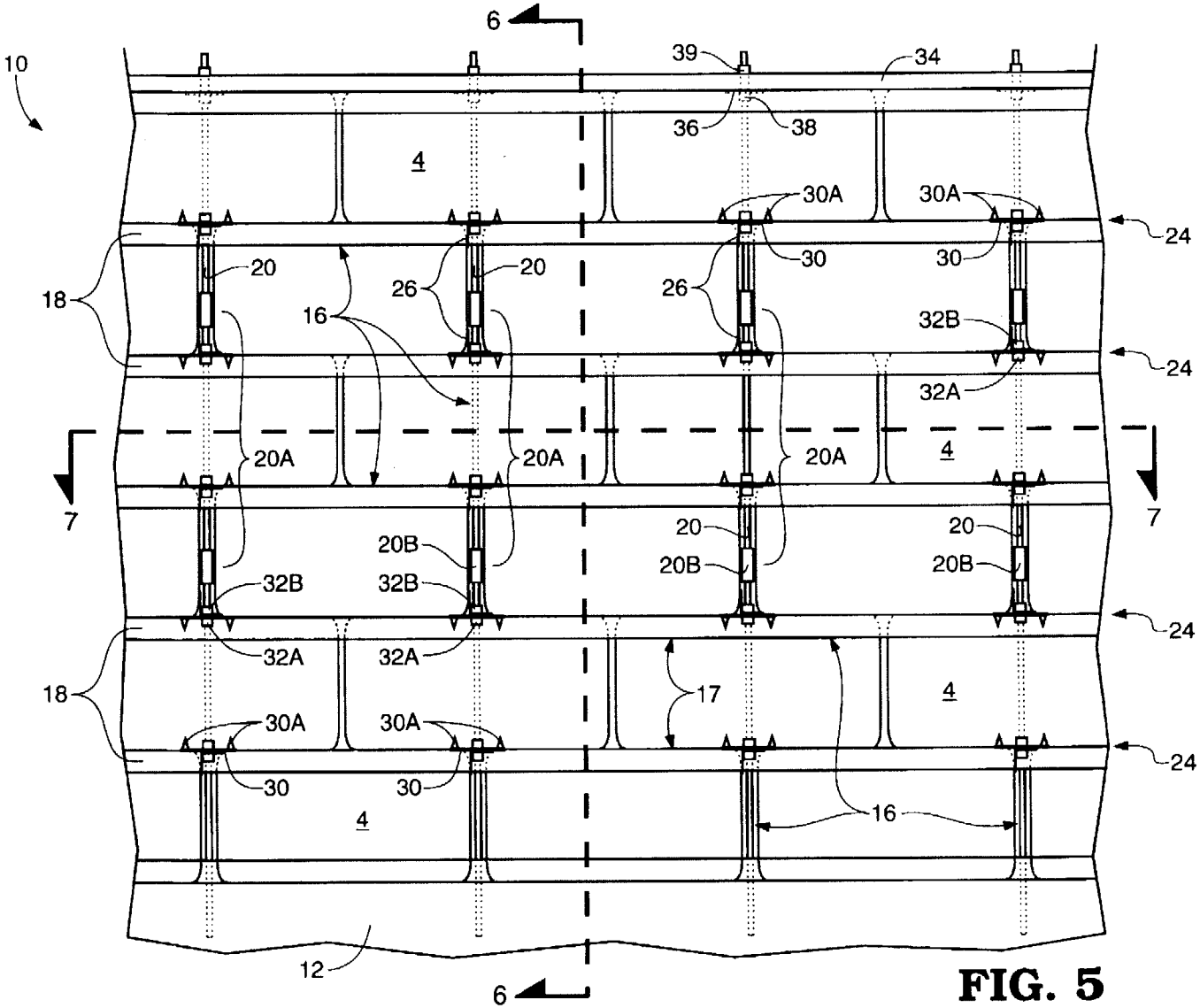
FIG. 5 is an elevation view showing a typical section of a wall constructed according one embodiment of the invention.
Figure 6:
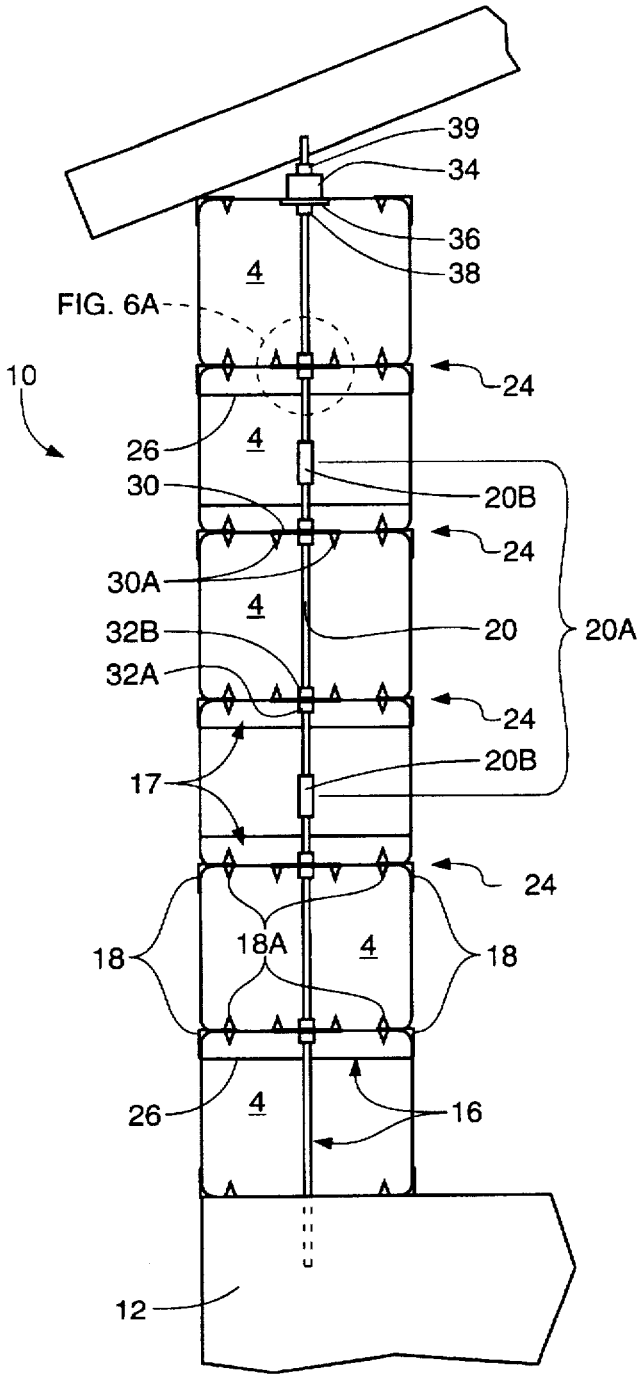
FIG. 6 is a cross section view of the wall taken along the line 6—6 in FIG. 5.
Figure 6A:
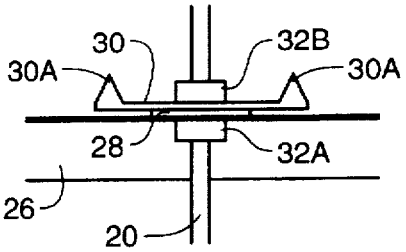
FIG. 6A is a detail view of the interconnection between components of the skeletal framework of the wall.
Figure 7:
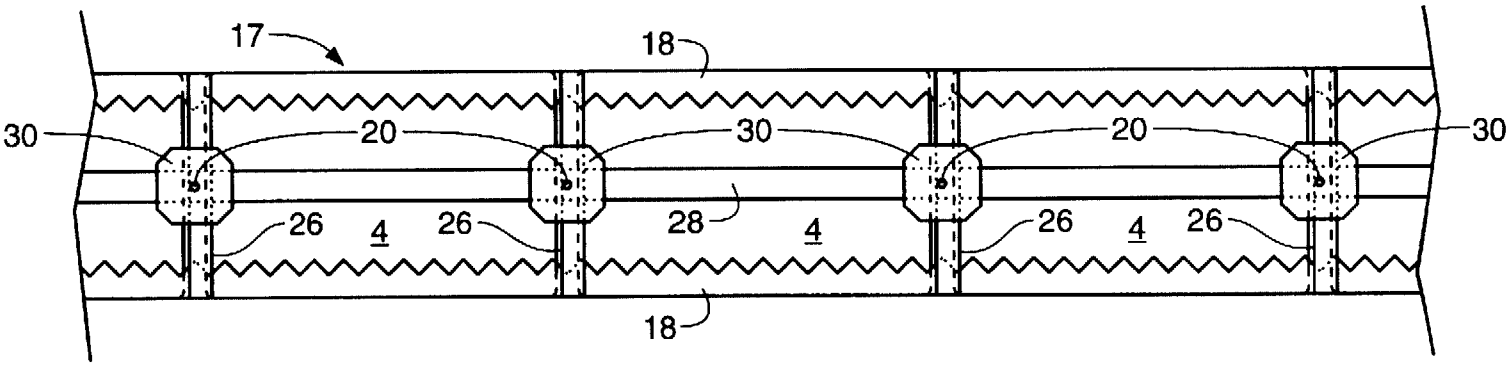
FIG. 7 is a cross section view of the wall taken along the line 7—7 in FIG. 5.

A bearing wall system is shown in FIGS. 5–7 as one exemplary embodiment of the invented composite structural building system. Referring to FIGS. 5–7, a bearing wall system 10 is shown constructed on a foundation 12. Bearing wall system 10 is also referred to herein as wall system 10 or simply as wall 10. Foundation 12 represents a conventional building foundation such as might be used in a typical residential or commercial building. Wall 10 is assembled by stacking bales 4 lengthwise in a staggered configuration, that is in "running bond," simultaneously with the erection of a skeletal framework 16. Alternatively, bales 4 may be stacked in a non-staggered configuration, that is in "stack bond." Running bond is preferred over stack bond due to the increased stability afforded by the running bond configuration.

Skeletal framework 16 includes a series of horizontal trussing members 18 and vertical rods 20. Vertical rods 20 are anchored in foundation 12 along the center line of wall 10. Vertical rods 20 will usually be spaced apart the nominal length of a bale, typically about forty eight inches. The spacing of vertical rods 20 may be varied as necessary to achieve the desired performance characteristics for wall 10. Preferably, rods 20 are constructed as steel rods having a circular cross section. As with the other components of skeletal framework 16, however, any structurally stable materials and cross sectional shapes may be used. Most preferably, rods 20 are threaded to facilitate the integration of the cross ties, tie straps and shear plates discussed below. For construction of an eight foot high wall, vertical rods 20 will normally comprise three, thirty six inch long threaded rod segments 20A. Rod segments 20A are spliced together with coupling nuts 20B to form rods 20. Rods 20 are segmented to allow the bales to be stacked without lifting alternate rows of bales, which are impaled on the rods, to the full wall height. Using segmented rods also facilitates the installation of other components of skeletal framework 16. Each vertical rod 20 may, however, be formed as a single continuous rod. Rods 20 are sized as necessary to safely support the anticipated loads for any particular wall system.

Bales 4 in each row are alternately laid between or impaled on rods 20. Trusses 17 act as horizontal beams to accommodate wind and other shear load requirements. Horizontal trussing members 18 and bales 4 comprise the basic components of trusses 17. Trussing members 18 form the chords of trusses 17. Bales 4 form the web of trusses 17. Trussing members 18 are installed in pairs at the outside faces of bales 4 along the horizontal interfaces 24 between bales 4. Horizontal trussing members 18 span each section of wall 10 defined by any two consecutive vertical bracing elements, such as intersecting walls and the vertical framing at doors and windows. The interactive connection between trussing members 18 and bales 4 is supplied by tooth like projections 18A on trussing members 18. One presently preferred configuration of projections 18A is shown in detail in FIG. 8. Projections 18A provide a mechanism for transferring shear forces between trussing members 18 and bales 4. Other suitable shear force transfer mechanisms could be used. For example, a series of studs 18B rigidly attached to the trussing members as shown in FIG. 8A. What is important is that the connection be operative to transfer shear forces between the trussing members 18 and the bales 4.

Figure 9:
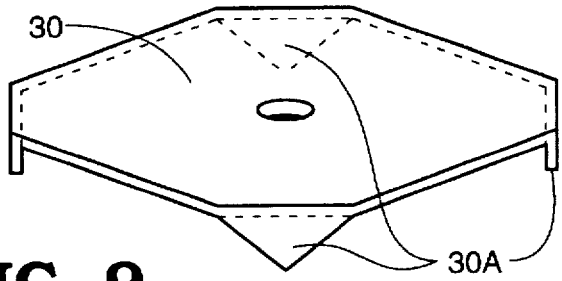
FIG. 9 is a detail perspective view of a shear plate.

The principal strategy of wall system 10 is to attain a constructed wall wherein rods 20 are locked into a fixed and stable position so that, when vertical compressive loads are imposed on rods 20, the loads are transferred directly down the rods. Rods 20 are stabilized by adding cross ties 26, tie straps 28 and shear plates 30 to skeletal framework 16. Cross ties 26 extend between trussing members 18 across horizontal bale interfaces 24 at the location of each rod 20. Rods 20 extend through the rod mounting hole formed at the mid-point of each cross tie 26. Tie straps 28 extend longitudinally along horizontal bale interfaces 24 between rods 20. Rods 20 extend through the rod mounting holes formed in tie straps 28 at spaced apart intervals corresponding to the nominal length of each bale 4. Each tie strap 28 may be formed as a single continuous strap along the length of the wall or as a series of strap segments spliced together to provide the required continuous structural integrity along the length of the wall. Shear plates 30 are installed on rods 20 at horizontal bale interfaces 24. The interactive connection between shear plates 30 and bales 4 is supplied by tooth like projections 30A on shear plates 30. One presently preferred configuration of projections 30A is shown in detail in FIG. 9. Preferably, shear plates 30 are oriented so that tooth like projections 30A penetrate the bales that are impaled on rods 20, as best seen in FIG. 5.

Nuts 32A or other suitable positioning devices are installed on rods 20 along horizontal interfaces 24 between bales 4 to properly locate cross ties 26, longitudinal straps 28 and shear plates 30 on rods 20. Cross ties 26, longitudinal straps 28 and shear plates 30 are placed on rods 20 to rest on nuts 32A along the top of each layer of bales as the wall is assembled. Nuts 32B or other suitable locking devices are then installed on rods 20. Cross ties 26, longitudinal straps 28 and shear plates 30 are sandwiched between nuts 32A and 32B and thereby locked into position on rods 20.

Cross ties 26 are the connecting device for transferring transverse out-of-plane stability to rods 20 at each horizontal bale interface 24. The stabilizing mechanism is horizontal truss 17. Longitudinal straps 28 maintain the vertical alignment of rods 20 in the plane of the wall. Shear plates 30 transfer the shear resistance of bales 4 to rods 20 at the horizontal bale interfaces 24.

Wall 10 is constructed with the placement of successive layers of bales and the corresponding installation of the components of skeletal framework 16. Segments 20A of rods 20 are joined together with coupling nuts 20B or other suitable coupling mechanism. To assure the wall is properly aligned, rods 20 are adjusted to the plane of the wall centerline as the other components of skeletal framework 16 are installed along the horizontal interfaces 24 between bales 4. This is accomplished, for example, by placing a horizontal string chalk line parallel to the wall centerline at each bale interface as construction progresses. The horizontal structural components are bumped inward or outward as required to correctly position the rods relative to the chalk line. The system has sufficient lateral resistance at this stage of construction to fix the rods in the adjusted position in much the same way the wet uncured mortar in a concrete block wall serves to maintain alignment as construction advances. When the rods are aligned and the bales are inside the outer face of trussing members 18, the outer face of trussing members 18 will be straight and trued to the chalk line because of the operative connection, i.e. cross ties 26, between rods 20 and trussing members 18. At the upper face of the top layer of bales, header 34 is installed on and supported by nuts 38. Preferably, anchorage clips 39 are installed on the tops of rods 20 to hold header 34 in place and to provide attachment points for roof panels or floor framing members. Preferably, bearing washers 36 are sandwiched between header 34 and nuts 38. Vertical compressive loads placed on header 34 are transferred to rods 20 through bearing washers 36 and nuts 38.

Utilizing trusses 17, cross ties 26, tie straps 28 and shear plates 30 as described, comparatively small diameter rods 20 effectively become columns capable of carrying the vertical stresses generated by live and dead gravity loads and wind and seismic loads. Rods 20 become a series of short stacked columns, each with an effective length equal to the nominal bale depth, typically about sixteen inches. This means that a six bale layer/eight foot high wall has the same load capacity as a one bale layer/sixteen inch high wall. The resulting rod column carries all of the vertical stress on the wall. The load path for bearing and uplift is directly to and from foundation 12 through rods 20. The bearing strength of wall 10 per bale length is the compressive strength of each bale length segment of rods 20. The uplift capacity per bale length is the lesser of either the tensile strength of rods 20 or the dead load supported by rods 20 plus one bale length's weight of attached foundation and associated structure. This means that in a tornado or hurricane the floors, walls and roof would not be vulnerable to separation from the building without either lifting the entire building including the foundation or failing the rods 20 in tension. Wall 10 has excellent thermal and sound insulation, transfers load without excessive distortion and resists uplift to a maximum level. In addition, vertical rods 20 facilitate excellent planer alignment of the wall. Since all wall components are operatively connected to rods 20, the alignment of the wall is defined by the alignment of the rods. Trusses 17, beside bracing rods 20, provide the bending strength required to resist lateral loads generated by wind or earthquake. Horizontal trussing members 18 function as wall girts to facilitate the application of conventional interior and exterior wall treatments, including dry wall, plywood, steel, stucco and the like.

The construction "recipe" for wall 10 may be varied to produce required levels of bearing and shear load capacity or to accommodate the attachment of different wall surfacings. For example, trussing members 18 and cross ties 26 may be omitted at some bale interfaces in areas of excess bearing capacity. Diagonal web ties may be added as cross bracing to augment the shear resistance of the bales at some interfaces. In addition, the size and shape of the various components of skeletal framework 16 may be varied as necessary to achieve the levels of bearing and shear load capacity. In-plane lateral bracing for wall 10, when not sufficiently supplied by bale shear resistance or sheeting shear resistance, may be supplied by diagonal cable type members (not shown) extending from header 34 to foundation 12 at any break in the linear continuity of the wall, such as occurs at a corner. The rod 20 at the corner then becomes the compressive member for this diagonal cable type bracing system.

Figure 10:
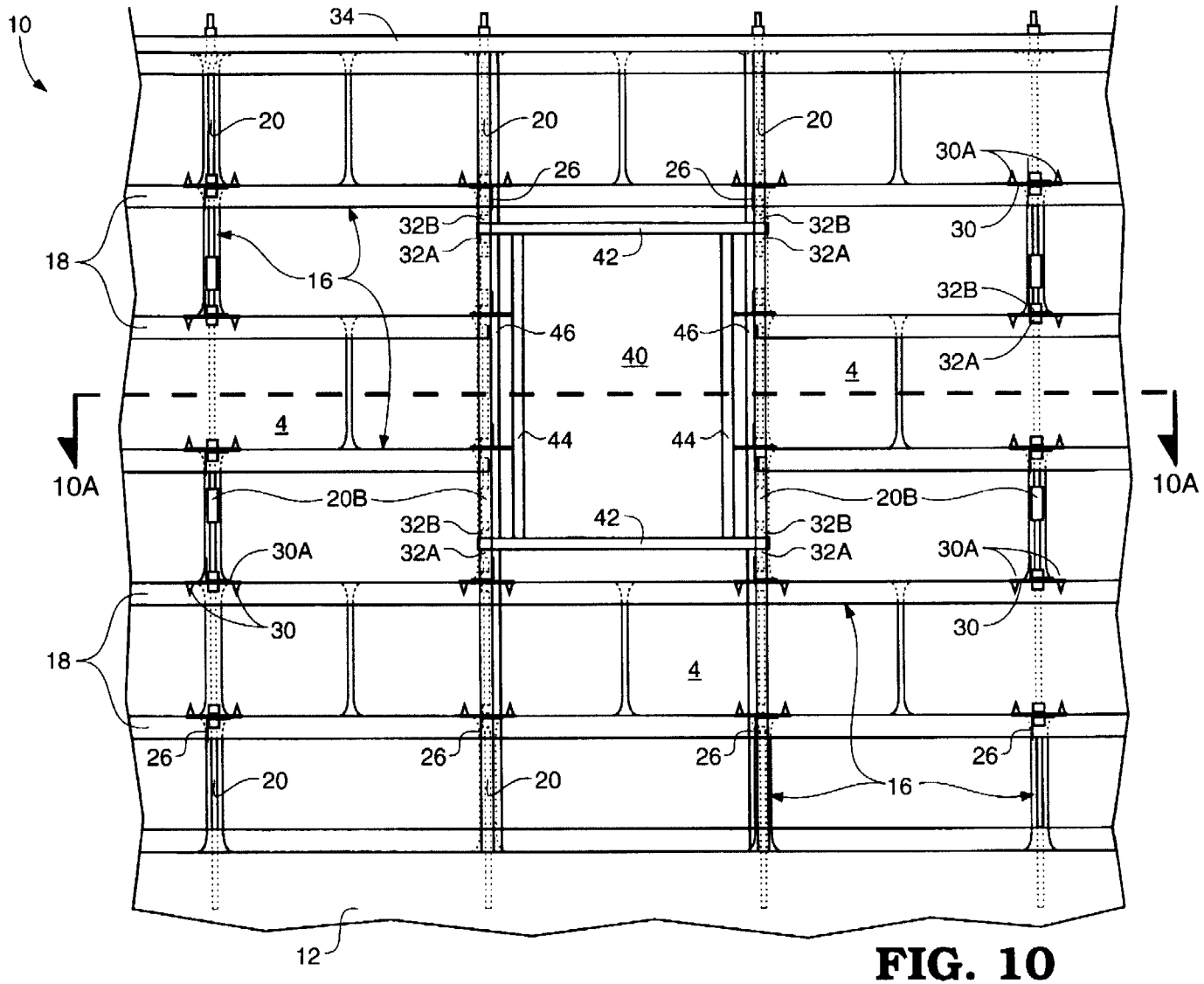
FIG. 10 is an elevation view showing a section of wall with a window frame installed.
Figure 10A:
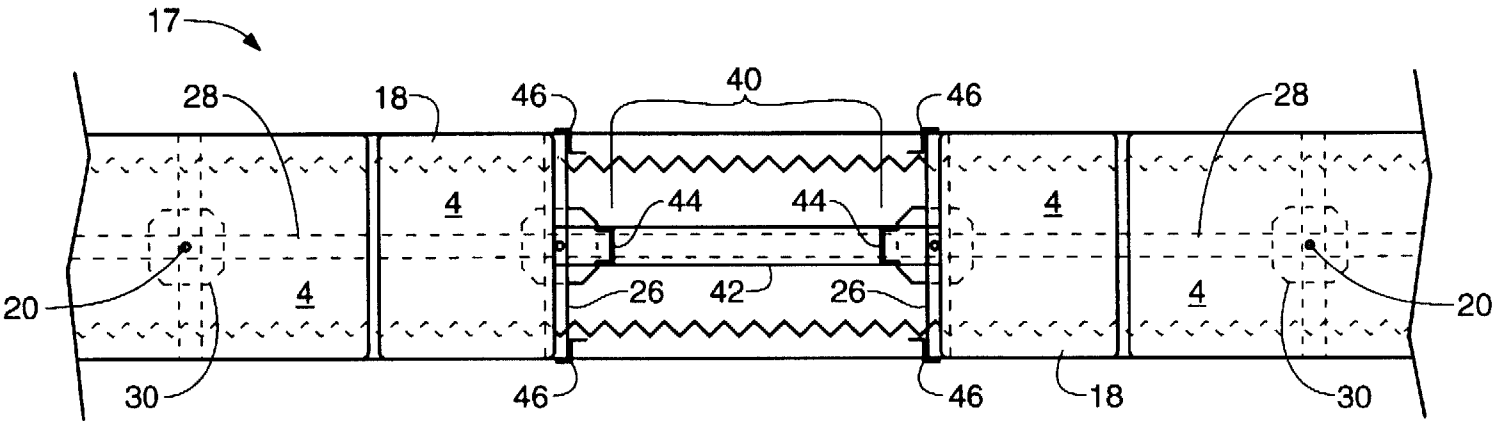
FIG. 10A is a cross section view of the wall taken along the line 10A—10A in FIG. 10.

The framing for doors and windows is tied into skeletal framework 16. For example, and referring to FIGS. 10 and 10A, window opening 40 is framed with horizontal channel shaped members 42. Channel members 42 are locked into rods 20 with a double nut arrangement such as that described above (nuts 32A and 32B) or with another suitable locking mechanism. One or more of the rods 20 may be omitted in this area to accommodate the width of opening 40. Header 34 may be adjusted in bending capacity as necessary to compensate for any rods that are omitted. Vertical channel shaped members 44 complete window opening 40. Vertical framing members 46 are installed and attached to cross ties 26 and trussing members 18 at rods 20 which anchor horizontal channel members 42. Vertical framing members 46 are installed in pairs on each side of opening 40. The outboard face of vertical framing members 46 is made flush with the inside and outside building lines, that is, in line with the face of trussing members 18. Vertical framing members 46 help stabilize rods 20 in the perpendicular to wall plane, create a termination point for trusses 17 and provide an anchorage for wall surfacing materials.

Figure 11:
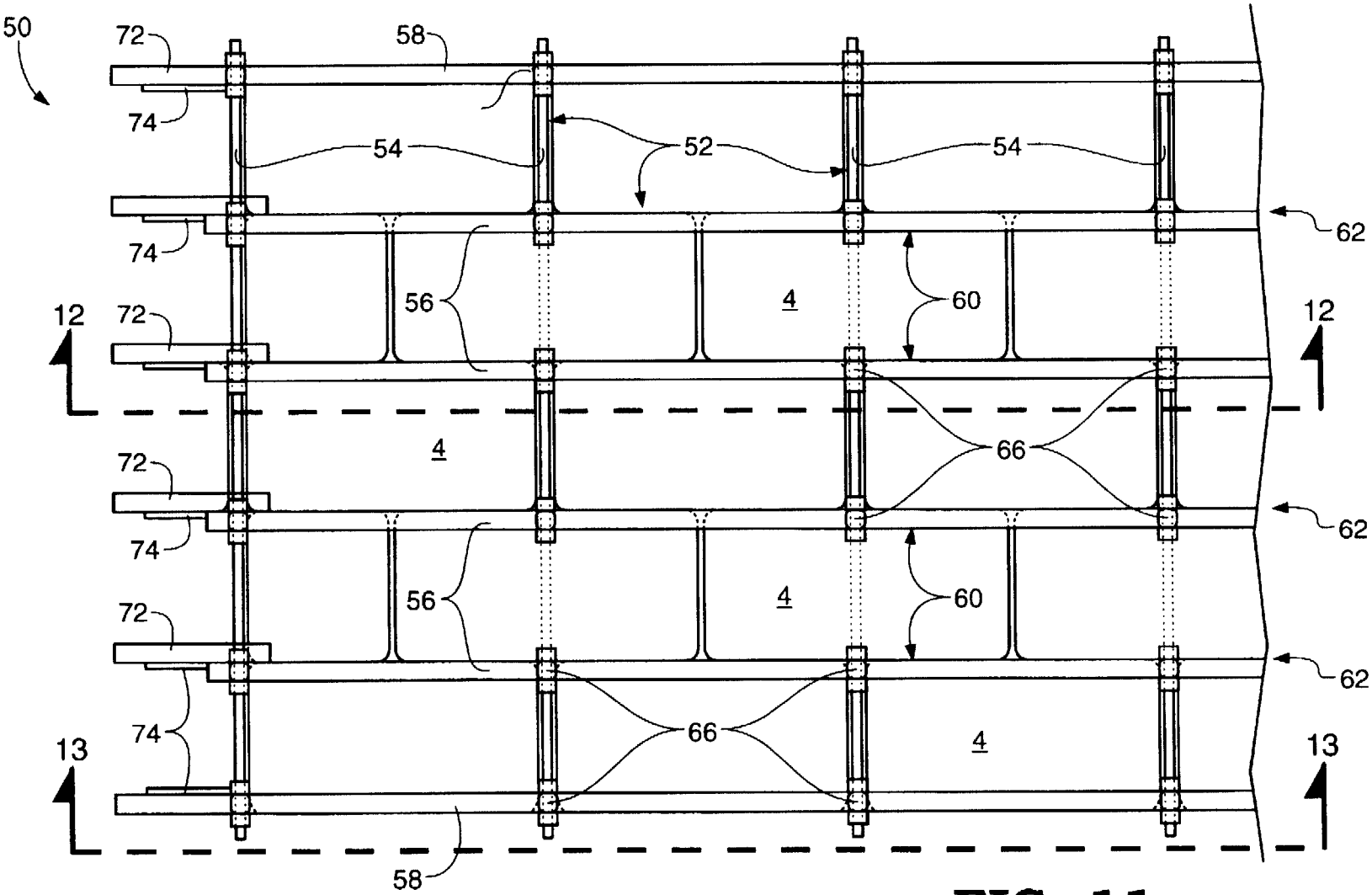
FIG. 11 is a plan view showing a typical section of a plank constructed according to a second embodiment of the invention.
Figure 12:
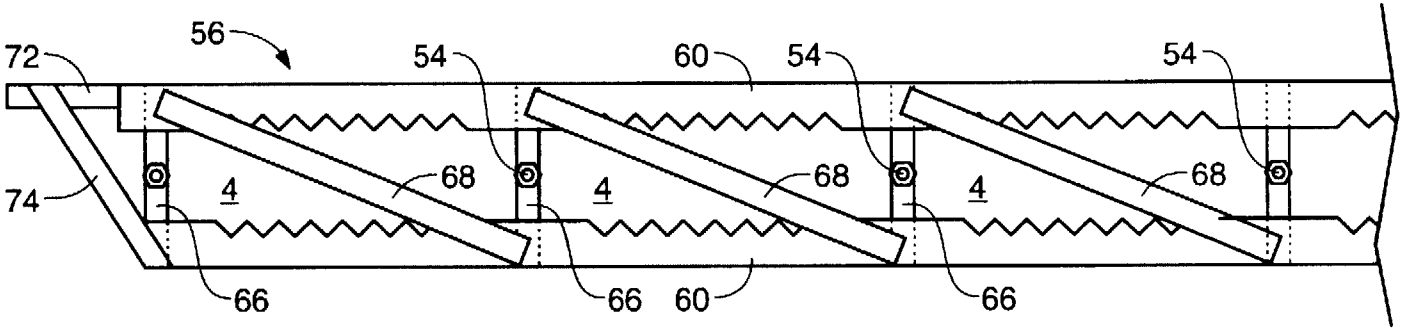
FIG. 12 is a cross section view of the plank taken along the line 12—12 in FIG. 11.
Figure 13:
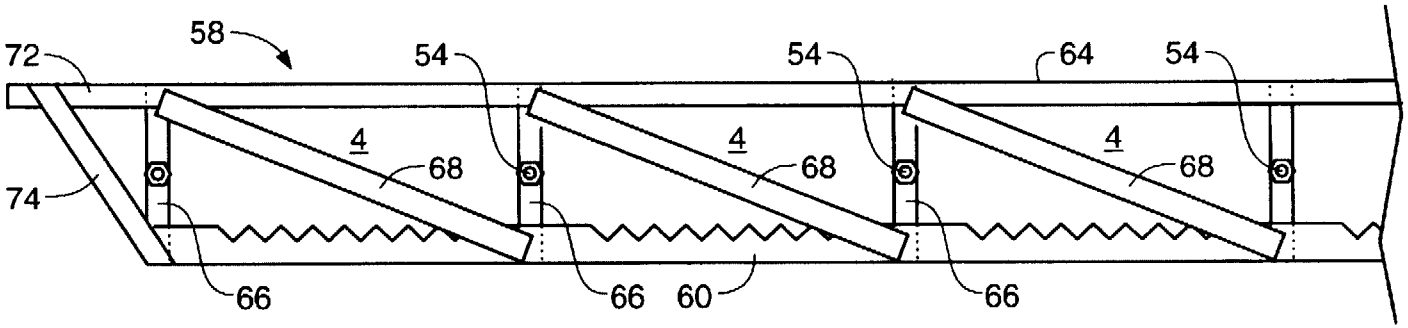
FIG. 13 is a cross section view of the plank taken along the line 13—13 in FIG. 11.
Figure 14:
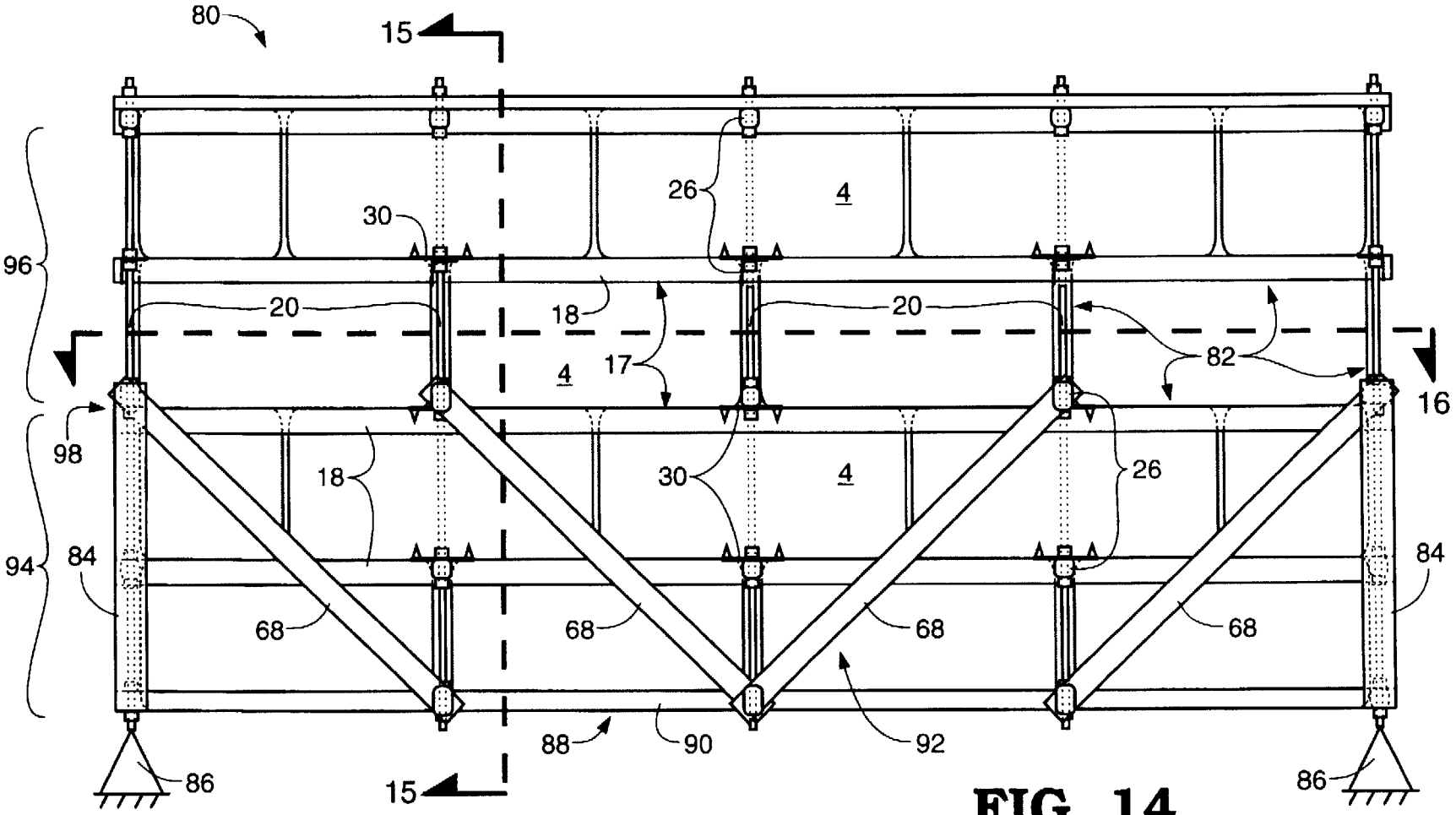
FIG. 14 is an elevation view showing a typical section of a two way beam constructed according to a third embodiment of the invention.
Figure 15:
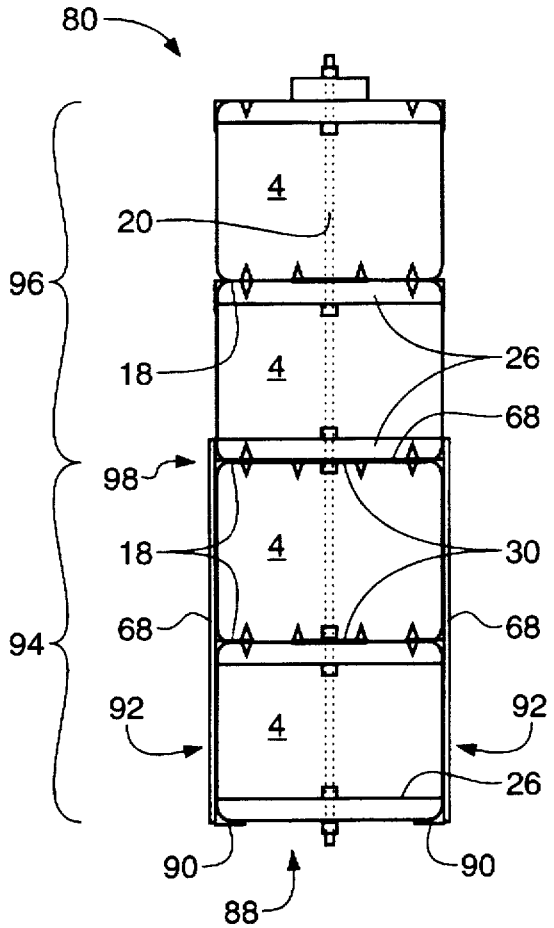
FIG. 15 is a cross section view of the beam taken along the line 15—15 in FIG. 14.

A plank system 50 is shown in FIGS. 11–13 as a second exemplary embodiment of the invention. Plank system 50, typically used for floor and roof panels, is also referred to for convenience as plank 50. Referring to FIGS. 11–13, bales 4 are arranged lengthwise in running bond simultaneously with the erection of skeletal framework 52. Skeletal framework 52 is similar to the skeletal framework used in the wall system, except that the rods are oriented horizontally and the tie straps and shear plates are deleted. Diagonal web ties and vertical struts supply creep proof shear resistance to the plank. Creep is the time dependent deflection or deformation exhibited by some materials, including straw bales, when they are subjected to long term continuous loading. The web ties and struts eliminate creep in plank 50. Exterior trusses are added along the edges of the plank to anchor the rods in skeletal framework 52.

Skeletal framework 52 includes a series of horizontal rods 54, interior trussing members 60 and exterior edge trussing members 64. Rods 54 are anchored in edge trusses 58 along the center line of plank 50. Rods 54 will normally be spaced apart the nominal length of a bale. The spacing of rods 54 may be varied as necessary to achieve the desired performance characteristics for plank 50. Preferably, rods 54 are segmented steel rods as described above for wall system 10. Also preferably, rods 54 are threaded to facilitate the integration of the struts discussed below.

Horizontal trussing members 60 and bales 4 comprise the basic components of interior trusses 56. Trussing members 60 are installed in pairs at the outside faces of bales 4 along the longitudinal vertical interfaces 62 between bales 4. Exterior edge trusses 58 are the same as interior trusses 56 except that the top trussing members 64 are constructed as a tube or similar such columnularly stable member.

In the preferred embodiment of plank 50, vertical struts 66 and diagonal web ties 68 are integrated into interior and exterior trusses 56 and 58 to increase the shear capacity of the plank. Struts 66 extend between trussing members 60 of interior trusses 56 across longitudinal vertical bale interfaces 62. Struts 66 also extend between top trussing member 64 and bottom trussing member 60 of exterior trusses 58. Struts 66 are spaced apart at nominal bale length. Rods 54 are installed through holes formed in the center of struts 66 with positioning/locking nuts 32A and 32B. Diagonal web ties 68 extend diagonally between trussing members 60 of interior trusses 56 across longitudinal vertical bale interfaces 62. Struts 66 and web ties 68 are operatively connected to trussing members 60 and top trussing members 64 at common points of intersection, commonly referred to as panel points, in a manner common to trusses.

Construction of plank 50 begins by assembling the components of one of the exterior trusses 58 as described above. Then, and referring to FIG. 11, bales 4 in the first row are impaled on rods 60 so that the outside faces of the bales in the first row are flush with the plane of the exterior truss. The vertical struts 66 of the first interior truss are then installed on rods 54 at a center to center distance of one bale depth from the vertical struts 66 installed on the same rods in exterior truss 58. The other components of the first interior truss are assembled as described above and the second row of bales are installed between rods 54. Construction of plank 50 continues by repeating the process of installing bales and assembling interior trusses until the desired panel width is realized. At that point, another exterior truss 58 is assembled.

Bearing tubes 72 and shear ties 74 are used at the ends of trusses 56 and 58 to mount the panels to a wall, beam or foundation. Bearing tubes 72 are fastened to and extend away from top trussing members 60 on interior trusses 56. Bearing tubes 72 are, preferably, a continuation of top trussing member 64 on exterior trusses 58. In either case, bearing tubes 72 will be operatively connected to a load bearing element in the main building structure. As best seen in FIGS. 12 and 13, shear ties 74 are connected diagonally between the end of the bottom trussing members 60 on interior and exterior trusses 56 and 58 and bearing tube 72.

Figure 8:
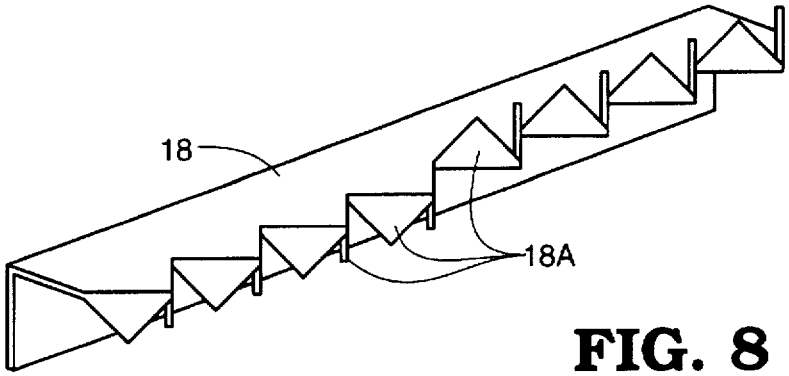
FIG. 8 is a detail perspective view of a toothed trussing member.
Figure 8A:
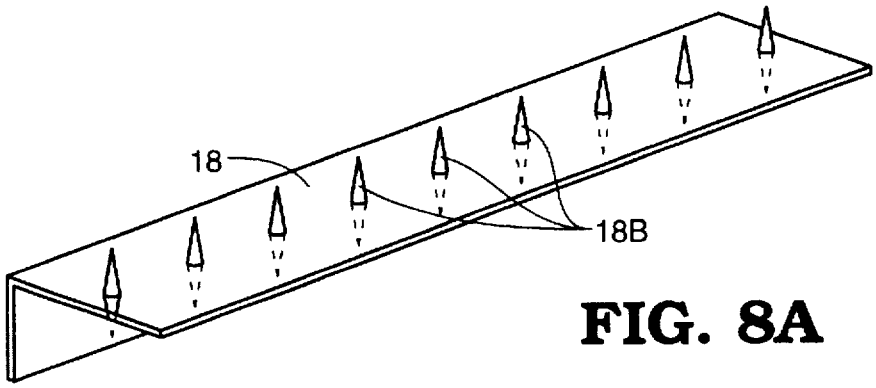
FIG. 8A is a detail perspective view of a studded trussing member.

The trussing members 60 in the second skeletal framework 52 are of similar construction to the trussing members 18 in the first skeletal framework 16 shown in FIG. 8. The tooth like projections 18A on members 60 grab the bales 4 to hold them in place. In the plank system, the interactive connection between bales 4 and the compression (top side) trussing members 60 performs a radial bracing function in a plane perpendicular to the long axis of trussing member 60 along its entire length by mobilizing the shear resistance of the bales. The continuous bracing along interior trusses 56 allows light gauge material to be used in the manufacture of both the top and bottom trussing members 60 in interior trusses 56. Top trussing member 64 of exterior truss 58 is not 100% braced along its length because it is not sandwiched between bales. Therefore, a tube or equivalently columnularly stable member 64 is used in exterior trusses 58.

Horizontal rods 54 in second skeletal framework 52 perform a different function than vertical rods 20 in skeletal framework 16. Horizontal rods 54, which are in tension rather than compression, hold the trusses and bales in a tight package. Interior trusses 56 are sandwiched tightly between the bales in adjoining rows to enhance the stabilizing effect of bales 4 on the top side trussing members 60.

The optimal load carrying version of plank 50 has been described. Load capacity may be engineered out of the plank system in the interest of economy by deleting truss assemblies from some of the bale interfaces. The finished roof or floor materials attached to the compression side of the planks supply added shear bracing that enhances the load carrying characteristics of plank 50.

The deformation performance, that is the bending deflection, of plank 50 is defined by the deformation performance of skeletal framework 52. In the case of a steel skeleton, a plank spanning twenty feet and a design stress of 24 ksi, the deflection (sag) at the center of the span would be approximately 0.4 inches. The invented plank system 50 has excellent thermal insulating qualities (R40+rated) and noise suppression characteristics. The planks will carry the live loads imposed in the floors and roofs of conventional residential and commercial buildings. Trussing members 60 and 64 provide a nominal sixteen inch on center one way grid on both faces of the plank for attaching conventional sheeting systems including dry wall, plywood, steel, and concrete.

A third embodiment of the invention is illustrated in FIGS. 14–17. Referring to FIGS. 14–17, a two way beam system 80, such as might be used for fences and other such free standing wall systems, is shown. Beam system 80, is also referred to for convenience as beam 80. Bales 4 are arranged lengthwise in running bond simultaneously with the erection of a skeletal framework 82. Skeletal framework 82 is similar to skeletal framework 16 used in wall 10, except that header 34 is deleted and diagonal web ties 68 are added at the outside faces of the beam to form vertical trusses 92. Vertical trusses 92 supply creep proof shear resistance. Diagonal web ties 68 may also be used at some of the horizontal bale interfaces to supply added cross bracing to trusses 17. End bearing frames 84 are installed at the ends of the bottom of beam 80 to transfer loads from the beam to individual footings 86 or other foundational elements.

Figure 16:
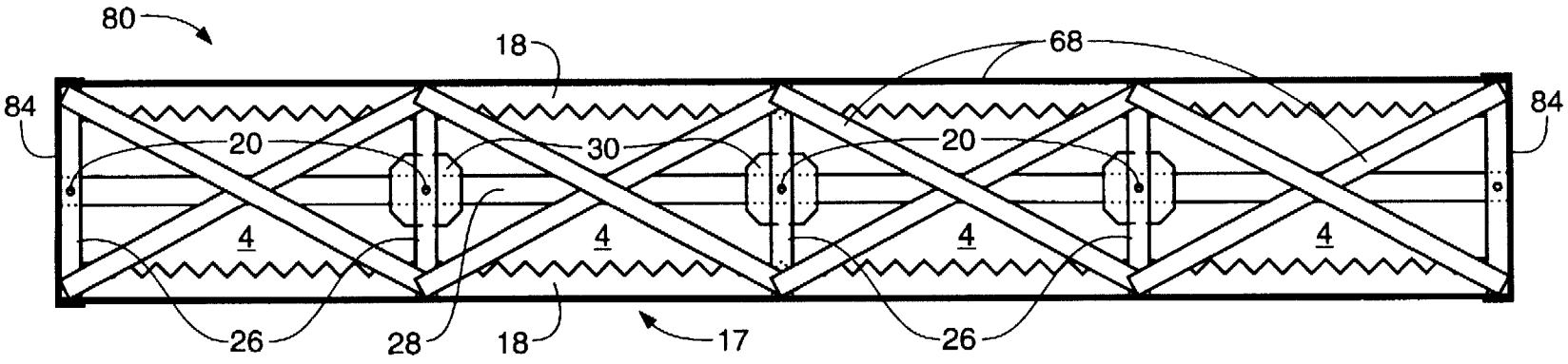
FIG. 16 is a cross section view of the beam taken along the line 16—16 in FIG. 14.
Figure 17:
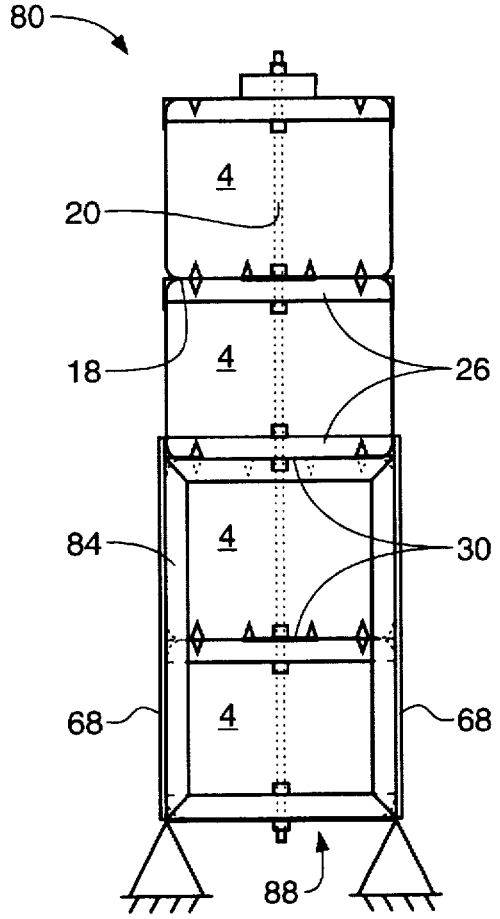
FIG. 17 is an end elevation view of the beam of FIG. 14.

Construction of beam 80 begins by assembling a base 88 for skeletal framework 82. Base 88 consists of longitudinal chords 90 positioned along the bottom and on both sides of beam 80. Chords 90 are operatively attached to cross ties 26. Bearing frames 84 are installed at the ends of the bottom of beam 80. A longitudinal tie strap 28 is installed across the bottom of cross ties 26. Tie strap 28 is operatively attached to bearing frames 84 at each end of beam 80. Vertical rods 20 are installed through holes in the center of cross ties 26 and through holes at nominal bale length spacing in tie strap 28. Rods 20 are properly positioned and secured to the other components with positioning/locking nuts 32A and 32B. Temporary shoring is placed under base 88 to support the weight of the panel until it becomes a structurally stable unit. Bales 4 in the first row are installed between rods 20 to rest on base 88 at the bottom of skeletal framework 82. Construction of beam 80 proceeds in identical fashion to the construction of wall 10 in the first embodiment of the invention up to the level of the wall where the top ends of web ties 68 attach to trussing members 18, usually the second or third row of bales. At that point, diagonal web ties 68 are attached to and extend between trussing members 18 at the horizontal bale interfaces, preferably in an x pattern, as best seen in FIG. 16.

At this point the primary structure of beam 80 is in place. Construction of beam 80 from this level to the top proceeds with the same components and method described for wall system 10. Rods 20 are terminated at the top edge of beam 80. Sheeting and a weather proof covering may then be installed as desired to finish the beam.

As in the other embodiments of the invention, the system works because the bales 4 act to brace the trussing members 18 and offer shear resistance to the entire system. The cross ties 26 in beam 80 perform differing functions depending on their position in the system and are designed accordingly. In the upper section 96, they perform as light duty struts where sheet gage angles suffice. At the beam base 88 and at the cross braced intermediate level 98, the cross ties transfer bending loads and are normally rectangular in cross section. At other areas, where they are medium duty struts, square tubing is appropriate. The rods 20 in the lower section 94 are out-of-plane compression elements in vertical trusses 92 and perform as described in the first embodiment of the invention. In the upper part 96 of beam 80, they may be in tension or compression depending on the external loading situation.

This third embodiment of the invention provides a recipe for constructing free standing, end supported fences or barriers that resist shear and moment forces in two orthogonal planes. The straw bales 4 provide continuous restraint for the compression elements of the horizontal and vertical trusses 17 and 92 in skeletal framework 82. The resulting beam system, in addition to providing a physical barrier to movement across a boundary, can be used as a sound barrier. Beam 80 can handle lateral loads in all directions and also transfer dead and live gravity loads to support footings 86.

The out to out dimensions on all wall, plank and beam pairs of trussing members 18, 60 and 18, respectfully, should be slightly more than the nominal bale width, about twenty five inches for a typical straw bale. The preferred sizes and cross sectional configurations of the various components of skeletal frameworks 16, 52 and 82 are listed below for a typical building application using steel components.

| Part and Part No. | Material | Cross Section | Length |
|---|---|---|---|
| Rods 20 | Threaded stock | Round, ¾" dia. | 3'–9' |
| Rods 54 | Threaded stock | Round, ½" dia. | 3'–12' |
| Tie straps 28 | Flat Sheet stock | 3" × 20 ga. | |
| Shear plate 30 | Flat plate with formed projections | 4" × 4" × 14 ga. | |
| Cross tie 26 (wall and upper portion of plank) | Sheet stock angle | 1½" × 1½" × 20 ga. | 2' |
| Cross tie 26 (lower portion of plank) | Rectangular or square tubing | 2½" × 1½" × ¼" 1½" × 1½" × 18 ga. | 2' |
| Trussing members 18 | Sheet stock angle with formed projections | 4½" × 1½" × 20 ga. | 8'–12' |
| Header 34 | Square tubing | 3" × 14 ga. | 20' |
| Rough framing 42, 44 at doors and windows | Sheet channel | 6" × 2" × 16 ga. | As Required |
| Web ties 68 | Flat sheet stock | 2" × 20 ga. | As Required |
| Auxillary framing 46 | Miscellaneous sheet stock Cees, Zees and Angles to facilitate sheeting attachment and framework bracing | L - 1½" × 1½" × 20 ga. C - 3½" × 1½" × 20 ga. Z - 3½" × 1½" × 20 ga. | As Required |

It is to be understood that the invention is not limited to the three exemplary embodiments shown and described above. Various other embodiments of the invention may be made and practiced without departing from the scope of the invention, as defined in the following claims.

What is claimed is:

1. A truss having chord members and a web member, comprising:

a. a bale; and b. a pair of trussing members operatively connected to the bale so that the trussing members form the chord members of the truss and the bale forms the web member of the truss.

2. A truss, comprising:

a. a bale; and b. a pair of trussing members, each trussing member in the pair operatively connected to the bale and positioned opposite another trussing member along an edge of the bale.

3. The truss according to claim 2, further comprising projections projecting from each trussing member to penetrate the bale and thereby operatively connect each trussing member to the bale.

4. The truss according to claim 2, further comprising a plurality of cross ties extending between the trussing members at substantially right angles.

5. A truss, comprising:

a. a pair of bales arranged so that each bale has a surface adjacent to a surface of another bale, the adjacent surfaces thereby defining an interface between the bales; and b. a pair of trussing members, each trussing member in the pair operatively connected to the bales and positioned opposite another trussing member along the interface between the bales.

6. The truss according to claim 5, further comprising projections projecting from the trussing members to penetrate the bales and thereby operatively connect the trussing members to the bales.

7. The truss according to claim 5, further comprising a plurality of cross ties extending between the trussing members at substantially right angles.

8. In a composite structural building system having a plurality of bales arranged in layers within a skeletal framework, the skeletal framework comprising:

a. a plurality of trussing members arranged in pairs, the trussing members in each pair operatively connected to the bales and positioned opposite one another along edges of the bales at interfaces between the layers; and b. a plurality of rods positioned along the layered bales between opposing trussing members.

9. In a wall system having a plurality of bales stacked in layers in a vertical plane within a skeletal framework, the skeletal framework comprising:

a. a plurality of trussing members arranged in pairs, the trussing members in each pair operatively connected to the bales and positioned opposite one another along edges of the bales at horizontal interfaces between the layered bales; and b. a plurality of rods oriented vertically and positioned along the layered bales between opposing trussing members.

10. The skeletal framework according to claim 9, further comprising a plurality of cross ties oriented horizontally, operatively coupled to the rods and extending between opposing trussing members.

11. The skeletal framework according to claim 9, further comprising a plurality of tie straps extending lengthwise along horizontal interfaces between layers of bales, each tie strap operatively coupled to at least two rods.

12. The skeletal framework according to claim 9, further comprising a plurality of shear plates oriented horizontally and operatively connected between at least some of the rods and the bales at horizontal interfaces between the layers.

13. The skeletal framework according to claim 9, further comprising a header connected across a top end of the rods.

14. The skeletal framework according to claim 9, further comprising projections projecting from the trussing members to penetrate the bales and thereby operatively connect the trussing members and the bales.

15. The skeletal framework according to claim 12, further comprising projections projecting from the shear plates to penetrate the bales and thereby operatively connect the shear plates to the bales.

16. In a plank system having a plurality of bales arranged in layers in a horizontal plane within a skeletal framework, the skeletal framework comprising:

a. a plurality of trussing members arranged in pairs, the trussing members in each pair operatively connected to the bales and positioned opposite one another along edges of the bales at interfaces between the layered bales; and b. a plurality of rods oriented horizontally and positioned along the layered bales between opposing trussing members.

17. The skeletal framework according to claim 16, further comprising a plurality of struts oriented vertically, operatively coupled to the rods and extending between opposing trussing members.

18. The skeletal framework according to claim 16, further comprising web ties attached to and extending diagonally between opposing trussing members at points of intersection of trussing members and struts.

19. The skeletal framework according to claim 16, further comprising projections projecting from each trussing member to penetrate the bales and thereby operatively connect the trussing members and the bales.

20. The skeletal framework according to claim 16, further comprising a plurality of bearing support members attached to and extending away from an end of at least some of the trussing members for connecting the framework to an external structure.

21. The skeletal framework according to claim 20, further comprising a plurality of shear ties attached to and extending diagonally between bearing support members and the attached trussing members.

22. In a beam system having a plurality of bales stacked in layers in a vertical plane within a skeletal framework, the skeletal framework comprising:

a. a plurality of trussing members arranged in pairs, the trussing members in each pair operatively connected to the bales and positioned opposite one another along edges of the bales at horizontal interfaces between the layered bales;

b. a plurality of rods oriented vertically and positioned along the layered bales between opposing trussing members;

c. a plurality of cross ties oriented horizontally, operatively coupled to the rods and extending between opposing trussing members; and d. a plurality of web ties attached to and extending diagonally between trussing members, each web tie spanning at least one layer of bales.

23. The skeletal framework according to claim 22, further comprising a plurality of tie straps extending lengthwise along horizontal interfaces between layers of bales, each tie strap operatively coupled to at least two rods.

24. The skeletal framework according to claim 22, further comprising projections projecting from each trussing member to penetrate the bales and thereby operatively connect the trussing members and the bales.

25. The skeletal framework according to claim 22, further comprising a plurality of shear plates oriented horizontally and operatively connected between at least some of the rods and the bales at horizontal interfaces between the layers.

26. The skeletal framework according to claim 25, further comprising projections projecting from each shear plate to penetrate the bales and thereby operatively connect the shear plates to the bales.

27. A wall system, comprising:

a. a plurality of bales stacked in layers in a vertical plane;

b. a plurality of trussing members arranged in pairs, the trussing members in each pair operatively connected to the bales and positioned opposite one another along edges of the bales at horizontal interfaces between the layered bales; and c. a plurality of rods oriented vertically and positioned along the layered bales between opposing trussing members.

28. The wall system according to claim 27, further comprising projections projecting from each trussing member to penetrate the bales and thereby operatively connect the trussing members to the bales.

29. The wall system according to claim 27, further comprising a plurality of cross ties oriented horizontally, operatively coupled to the rods and extending between opposing trussing members.

30. The wall system according to claim 27, further comprising a plurality of tie straps extending lengthwise along horizontal interfaces between layers of bales, each tie strap operatively coupled to at least two rods.

31. The wall system according to claim 27, further comprising a plurality of shear plates oriented horizontally and operatively connected between the bales and at least some of the rods at horizontal interfaces between the layers.

32. The wall system according to claim 27, further comprising a header connected across a top end of the rods.

33. A wall system according to claim 31, further comprising projections projecting from each shear plate to penetrate the bales and thereby operatively connect the shear plates to the bales.

34. A plank system, comprising:

a. a plurality of bales arranged in layers in a horizontal plane;

b. a plurality of trussing members arranged in pairs, the trussing members in each pair operatively connected to the bales and positioned opposite one another along edges of the bales at interfaces between the layered bales; and c. a plurality of rods oriented horizontally and positioned along the layered bales between opposing trussing members.

35. The plank system according to claim 34, further comprising projections projecting from each trussing member to penetrate the bales and thereby operatively connect the trussing members to the bales.

36. The plank system according to claim 34, further comprising a plurality of struts oriented vertically, operatively coupled to the rods and extending between opposing trussing members.

37. The plank system according to claim 34, further comprising web ties attached to and extending diagonally between opposing trussing members at points of intersection of trussing members and struts.

38. The plank system according to claim 34, further comprising a plurality of bearing support members attached to and extending away from an end of at least some of the trussing members for connecting the plank system to an external structure.

39. The plank system according to claim 34, further comprising a plurality of shear ties attached to and extending diagonally between bearing support members and the attached trussing members.

40. A beam system, comprising:

a. a plurality of bales stacked in layers in a vertical plane;

b. a plurality of trussing members arranged in pairs, the trussing members in each pair operatively connected to the bales and positioned opposite one another along edges of the bales at horizontal interfaces between the layered bales;

c. a plurality of rods oriented vertically and positioned along the layered bales between opposing trussing members;

d. a plurality of cross ties oriented horizontally, operatively coupled to the rods and extending between opposing trussing members; and e. a plurality of web ties attached to and extending diagonally between trussing members, each web tie spanning at least one layer of bales.

41. The beam system according to claim 40, further comprising projections projecting from each trussing member to penetrate the bales and thereby operatively connect the trussing members to the bales.

42. The beam system according to claim 40, further comprising a plurality of tie straps extending lengthwise along horizontal interfaces between layers of bales, each tie strap operatively coupled to at least two rods.

43. The beam system according to claim 40, further comprising a plurality of shear plates oriented horizontally and operatively connected between the bales and at least some of the rods at horizontal interfaces between the layers.

44. The beam system according to claim 43, further comprising projections projecting from each shear plate to penetrate the bales and thereby operatively connect the shear plates to the bales.

* * * * *